US009837008B2

(12) United States Patent
Peana et al.

(10) Patent No.: US 9,837,008 B2
(45) Date of Patent: Dec. 5, 2017

(54) INFORMATION HANDLING SYSTEM WITH A DOUBLE BLUE-BLUE PIXEL STRUCTURE ARRANGEMENT

(71) Applicant: Dell Products, LP, Round Rock, TX (US)

(72) Inventors: Stefan Peana, Austin, TX (US); Mitchell A. Markow, Hutto, TX (US)

(73) Assignee: DELL PRODUCTS, LP, Round Rock, TX (US)

( * ) Notice: Subject to any disclaimer, the term of this patent is extended or adjusted under 35 U.S.C. 154(b) by 5 days.

(21) Appl. No.: 14/865,957

(22) Filed: Sep. 25, 2015

(65) Prior Publication Data

US 2017/0092168 A1 Mar. 30, 2017

(51) Int. Cl.
*G09G 3/00* (2006.01)

(52) U.S. Cl.
CPC ..... *G09G 3/007* (2013.01); *G09G 2300/0452* (2013.01); *G09G 2330/04* (2013.01)

(58) Field of Classification Search
CPC ..... H04N 1/6008; G09G 3/364; G09G 3/007; G09G 2300/0452
See application file for complete search history.

(56) References Cited

U.S. PATENT DOCUMENTS

| | | | |
|---|---|---|---|
| 7,755,569 | B2 | 7/2010 | Wang et al. |
| 8,680,518 | B2 | 3/2014 | Kim et al. |
| 2007/0159492 | A1 | 7/2007 | Lo et al. |
| 2009/0021534 | A1 | 1/2009 | Tomizawa et al. |
| 2016/0055821 | A1* | 2/2016 | Phan ..... G02F 1/133514 345/592 |
| 2016/0254326 | A1* | 9/2016 | Ji ..... H01L 21/77 257/40 |

* cited by examiner

*Primary Examiner* — Antonio A Caschera
(74) *Attorney, Agent, or Firm* — Larson Newman, LLP

(57) ABSTRACT

A display for an information handling system includes a first color sub-pixel of a first color type, a second color sub-pixel of a second color type, a third color sub-pixel of a third color type, and a fourth color sub-pixel of the second color type. The first, second, third, and fourth color sub-pixels are placed horizontally adjacent to a color sub-pixel of another type in a row of the display. The first color sub-pixel is located at a first position, the second color sub-pixel is located at a second position, the third color sub-pixel is located at a third position, and the fourth color sub-pixel is located a fourth position of the row.

14 Claims, 6 Drawing Sheets

INFORMATION HANDLING SYSTEM WITH A DOUBLE BLUE-BLUE PIXEL STRUCTURE ARRANGEMENT

FIELD OF THE DISCLOSURE

The present disclosure generally relates to information handling systems, and more particularly relates to an information handling system with a double blue-blue pixel structure arrangement.

BACKGROUND

As the value and use of information continues to increase, individuals and businesses seek additional ways to process and store information. One option is an information handling system. An information handling system generally processes, compiles, stores, or communicates information or data for business, personal, or other purposes. Technology and information handling needs and requirements can vary between different applications. Thus information handling systems can also vary regarding what information is handled, how the information is handled, how much information is processed, stored, or communicated, and how quickly and efficiently the information can be processed, stored, or communicated. The variations in information handling systems allow information handling systems to be general or configured for a specific user or specific use such as financial transaction processing, airline reservations, enterprise data storage, or global communications. In addition, information handling systems can include a variety of hardware and software resources that can be configured to process, store, and communicate information and can include one or more computer systems, graphics interface systems, data storage systems, networking systems, and mobile communication systems. Information handling systems can also implement various virtualized architectures. Data and voice communications among information handling systems may be via networks that are wired, wireless, or some combination.

An information handling system can include an organic light-emitting diode (OLED) display. The OLED display can include different color sub-pixels, such as red, green, and blue, and these color sub-pixels can be turned on at different levels and blended together to render the colors displayed on the OLED display.

BRIEF DESCRIPTION OF THE DRAWINGS

It will be appreciated that for simplicity and clarity of illustration, elements illustrated in the Figures are not necessarily drawn to scale. For example, the dimensions of some elements may be exaggerated relative to other elements. Embodiments incorporating teachings of the present disclosure are shown and described with respect to the drawings herein, in which.

The use of the same reference symbols in different drawings indicates similar or identical items.

DETAILED DESCRIPTION OF THE DRAWINGS

The following description in combination with the Figures is provided to assist in understanding the teachings disclosed herein. The description is focused on specific implementations and embodiments of the teachings, and is provided to assist in describing the teachings. This focus should not be interpreted as a limitation on the scope or applicability of the teachings.

Figure 1:
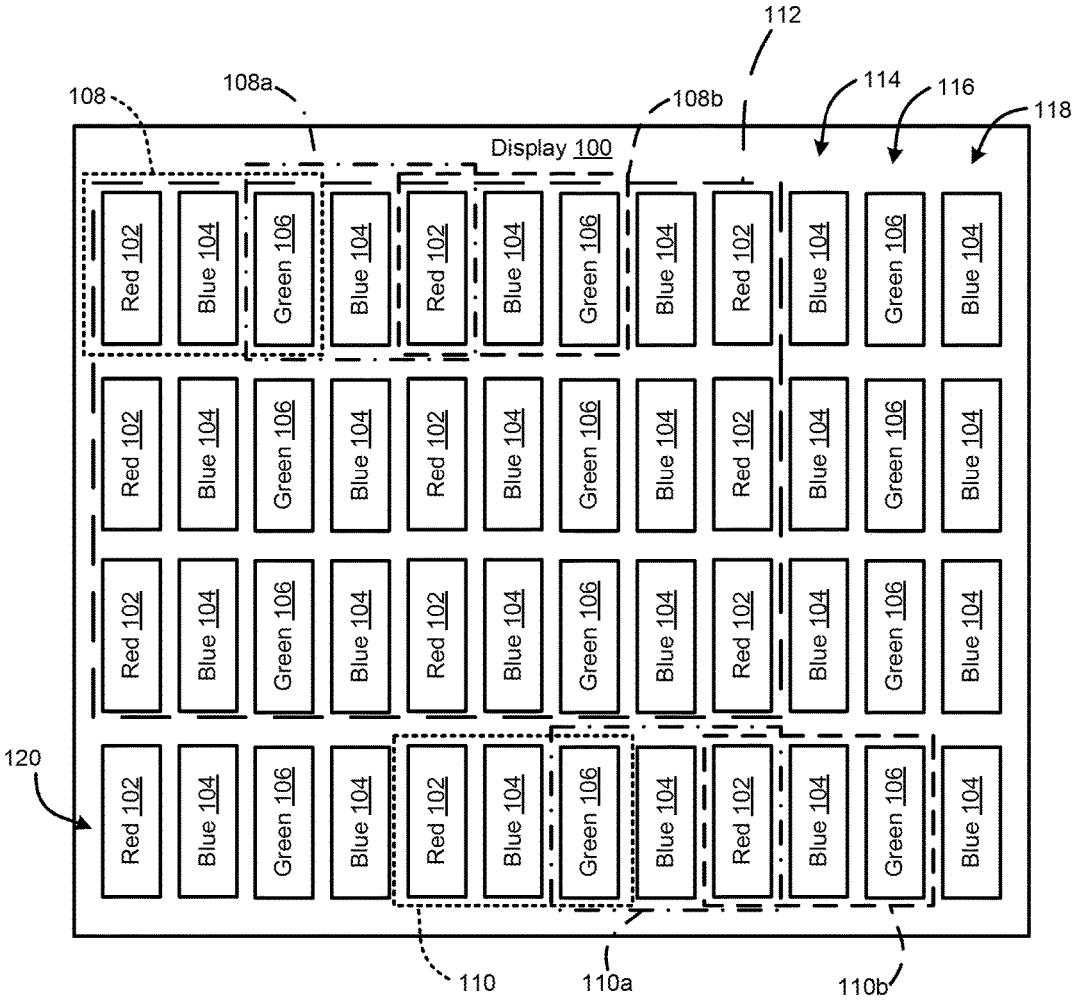
FIG. 1 is a diagram of an embodiment of color pixels on a display of an information handling system in accordance with at least one embodiment of the present disclosure.

FIG. 1 shows a display 100 for an information handling system. In the embodiments described herein, an information handling system includes any instrumentality or aggregate of instrumentalities operable to compute, classify, process, transmit, receive, retrieve, originate, switch, store, display, manifest, detect, record, reproduce, handle, or use any form of information, intelligence, or data for business, scientific, control, entertainment, or other purposes. For example, an information handling system can be a personal computer, a consumer electronic device, a network server or storage device, a switch router, wireless router, or other network communication device, a network connected device (cellular telephone, tablet device, etc.), or any other suitable device, and can vary in size, shape, performance, price, and functionality.

The information handling system can include memory (volatile (such as random-access memory, etc.), nonvolatile (read-only memory, flash memory etc.) or any combination thereof), one or more processing resources, such as a central processing unit (CPU), a graphics processing unit (GPU), hardware or software control logic, or any combination thereof. Additional components of the information handling system can include one or more storage devices, one or more communications ports for communicating with external devices, as well as, various input and output (I/O) devices, such as a keyboard, a mouse, a video/graphic display, or any combination thereof. The information handling system can also include one or more buses operable to transmit communications between the various hardware components. Portions of an information handling system may themselves be considered information handling systems.

The display 100 can be any type of display, such as a light-emitting diode (LED) display, an organic LED (OLED) display, or the like. The display 100 includes multiple red sub-pixels 102, multiple blue sub-pixels 104, and multiple green sub-pixels 106. A first pixel 108 of the display 100 is created in response to one red sub-pixel 102, one blue sub-pixel 104, and one green sub-pixel 106 being provided with a current to place these sub-pixels in an on state. A second pixel 110 is created in response to another red sub-pixel 102, another blue sub-pixel 104, and another green sub-pixel 106 being provided with a current to place the sub-pixels in an on state.

The sub-pixels 102, 104, and 106 are arranged in rows and column on the display 100, such that the sub-pixels are placed horizontally adjacent to a color sub-pixel of another type in a row of the display. For example, the locations of the sub-pixels in each row are as follows: red sub-pixel 102 in a first position; blue sub-pixel 104 in a second position; green sub-pixel 106 in a third position; blue sub-pixel 104 in a fourth position; red sub-pixel 102 in a fifth position; blue sub-pixel 104 in a sixth position; green sub-pixel 106 in a seventh position; blue sub-pixel 104 in an eighth position; red sub-pixel 102 in a ninth position; blue sub-pixel 104 in a tenth position; and a green sub-pixel 106 in a eleventh position. In an embodiment, the positions of the sub-pixels are based on a distance from an edge of the display 100. For example, blue sub-pixel 104 in the second position is further from the edge of the display 100 than the red sub-pixel 102 in the first position. For clarity and brevity, only a portion of the sub-pixels on the display have been shown in FIG. 1. However, one of ordinary skill in the art would recognize that the order of the sub-pixels stated above can continue across the display until a sufficient number of sub-pixels are used to provide a desired resolution of the display 100.

In a typical display, the sub-pixels rotate between the sub-pixel colors to create a pixels. For example, the sub-pixels can rotate across a row of a display in the following order: red, green, blue, red, green, blue, and the like. In this example, each group of one red, one green, and one blue sub-pixel can be a single pixel. Some displays perform pixel shifting, which periodically moves an entire video or image frame vertically and/or horizontally so that the display does not have a static image. Pixel shifting can be imperceptible to a viewer and still prevent image retention and burn-ins on the display. Pixel shifting in a typical display can shift a pixel from one sub-pixel group to the next, such that all of the sub-pixels in each group are in the on state during the pixel shifting. For example, all of the sub-pixels in a first group of sub-pixels can be in an on state to create a first pixel in an image, and all of the sub-pixels in a second group of sub-pixels can be in an on state to create a second pixel in the image. Then in response to pixel shifting the first pixel can be shifted to the second sub-pixel group, such that all of the sub-pixels in the second group of sub-pixels can be in an on state to create the first pixel in the image after pixel shifting. Thus, each sub-pixel, such as the red, green, and blue sub-pixels, in a typical display is provided with current during each shift of the image during the pixel shifting.

Display 100 can perform pixel shifting by shifting the image by one or two pixels horizontally. For example, a first pixel can be created at a location 108 in an image on display 100 in response to the red sub-pixel 102, the blue sub-pixel 104, and the green sub-pixel 106, located within the box identified with the 108 in FIG. 1, being provided with current and placed in an on state. In this example, the red sub-pixel 102, the blue sub-pixel 104, and the green sub-pixel 106 can be provided with different current levels to have the desired blend of the three sub-pixels to create the color of the first pixel at location 108. The display 100 can then perform pixel shifting, and the first pixel can shift horizontally from location 108 to the location identified by the box 108*a* in FIG. 1. When the first pixel is shifted to location 108*a* the first pixel is created by the combination of the red sub-pixel 102, the blue sub-pixel 104, and the green sub-pixel 106 within the box 108*a*. In this situation, the green sub-pixel 106 is shared by the first pixel in both locations 108 and 108*a*. In an embodiment, the image on the display 100 can be pixel shifted again and the location of the first pixel can shift to location 108*b*. At this location, the first pixel is created by the combination of the red sub-pixel 102, the blue sub-pixel 104, and the green sub-pixel 106 within the box 108*b*, such that a red sub-pixel is shared by the first pixel while in both location 108*a* and 108*b*. Thus, the red sub-pixels 102 and the green sub-pixels 106 are shared between pixel shifting locations. However, the blue sub-pixels 104 are not shared between pixel shifting locations.

Display 100 can perform pixel shifting in a second pixel. For example, the second pixel can be created at a location 110 on display 100 in response to the red sub-pixel 102, the blue sub-pixel 104, and the green sub-pixel 106, located within the box identified with the 110 in FIG. 1, being provided with current and placed in an on state. The display 100 can then perform pixel shifting, and the second pixel can shift horizontally from location 110 to the location identified by the box 110*a* in FIG. 1. When the second pixel is shifted to location 110*a* the second pixel is created by the combination of the red sub-pixel 102, the blue sub-pixel 104, and the green sub-pixel 106 within the box 110*a*. In this situation, the green sub-pixel 106 is shared by the second pixel in both locations 110 and 110*a*. In an embodiment, the image on the display 100 can be pixel shifted again and the location of the second pixel can shift to location 110*b*. At this location, the second pixel is created by the combination of the red sub-pixel 102, the blue sub-pixel 104, and the green sub-pixel 106 within the box 110*b*, such that a red sub-pixel is shared by the second pixel while in both location 110*a* and 110*b*. Thus, the red sub-pixels 102 and the green sub-pixels 106 are shared between pixel shifting locations. However, the blue sub-pixels 104 are not shared between pixel shifting locations.

Depending on a material usage some of display configurations there can be a 3:1 differential in the degradation of the sub-pixels between blue sub-pixels 104 and red sub-pixels 102. Also, there can be a 2:1 differential in the degradation of the sub-pixels between blue sub-pixels 104 and green sub-pixels 106. The sub-pixel arrangement on display 100, can enable the blue sub-pixels 104 to be in an off state half the time in response to the blue sub-pixels not being shared between pixel shifting locations, such as between location 108 and 108*a*, and between location 108*a* and 108*b*. The reduced amount of time that the blue sub-pixels 104 are as compared to the red sub-pixels 102 can lower the degradation difference between the blue sub-pixels and the red sub-pixels. Similarly, reduced amount of time that the blue sub-pixels 104 are as compared to the green sub-pixels 106 can lower the degradation difference between the blue sub-pixels and the green sub-pixels.

In an embodiment, each pixel can include four sub-pixels. For example, a pixel can include, in order horizontally across a row, one red sub-pixel 102, one blue sub-pixel 104, one green sub-pixel 106, and another blue sub-pixel 104. In this embodiment, each blue sub-pixel 104 may be powered on a 50% of the total overall power capacity for the pixel color. Thus, the life time degradation of the blue sub-pixels 104 can be reduced in response to the blue sub-pixels 104 being driven at 50% rather than 100%. Also, in this embodiment, pixel shifting can move from one set of four sub-pixels to an adjacent group of four sub-pixels either vertically or horizontally. In this situation, there pixel shifting can result without any of the sub-pixels being reused from one pixel location to the next.

In an embodiment, the resolution, pixels per inch (PPI), of the display 100 can be above visible range. For example, the resolution can be 300 PPI×1.4423=424 PPI. In an embodiment, the high resolution of the display 100 can enable the blue sub-pixels 106 in the off state to not be visible. Additionally, the resolution of the display 100 can make the pixel shifting of the image not be visible. The display 100 can have additional blue sub-pixels as compared to typical displays, such that the display 100 can include additional rows and/or columns as compared to a typical display to enable pixel shifting in the display 100. For example, a typical display may only include the sub-pixels located with box 112. However, display 100 can include additional columns sub-pixels 114, 116, and 118, and an additional row of sub-pixels 120 to enable pixel shifting with the additional blue sub-pixels 104.

Figure 2:
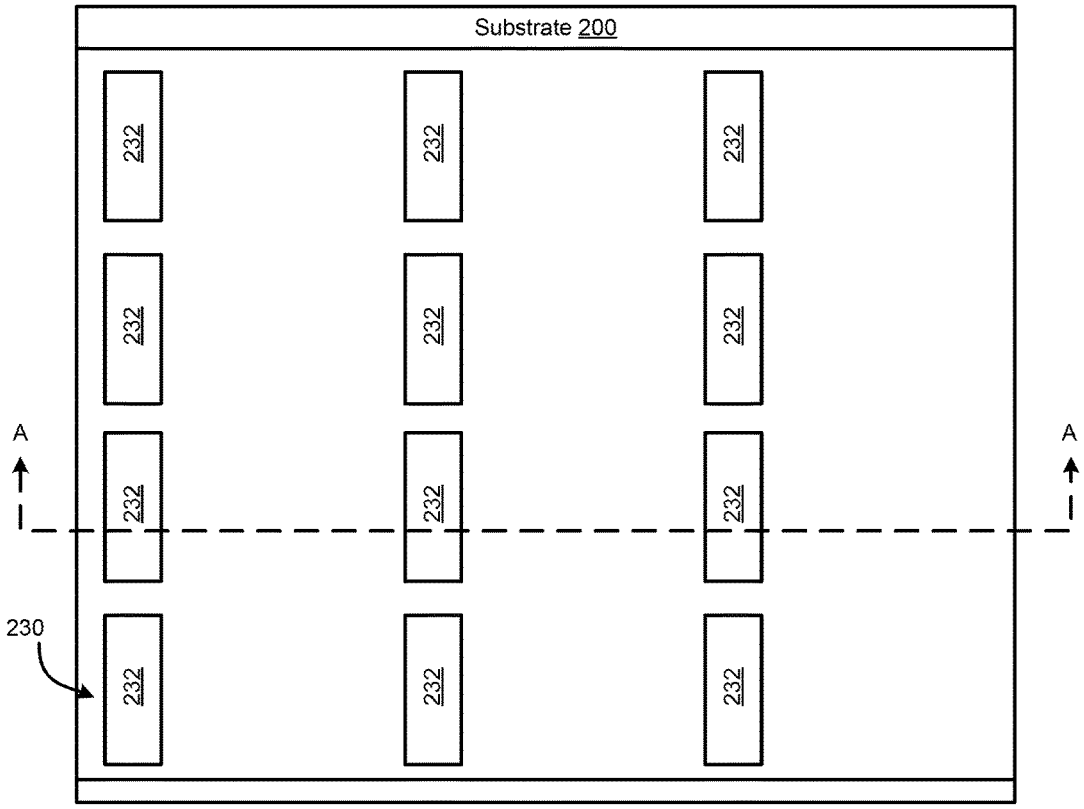
FIG. 2 is a diagram illustrating a first manufacturing mask on a substrate of the display in accordance with at least one embodiment of the present disclosure.
Figure 3:
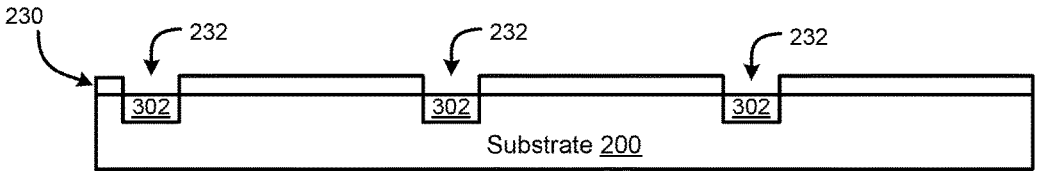
FIG. 3 is a diagram illustrating a cross section of the first manufacturing mask and the substrate in accordance with at least one embodiment of the present disclosure.

FIGS. 2 and 3 illustrate a first manufacturing mask 230 on a substrate 200 of a display in accordance with at least one embodiment of the present disclosure. The substrate 200 can be a first type of semiconductor material, such as n-type or a p-type. The mask 230 is then applied on top of the substrate. In an embodiment, the mask 230 includes a plurality of holes 232 to enable red sub-pixels to be added to the substrate 200. FIG. 3 illustrates a cross section of the substrate 200 and the mask 230 taken along the line A-A in accordance with at least one embodiment of the present disclosure.

Referring now to FIG. 3, the substrate 200 can be doped, such as through ion implantation, diffusion of dopants, epitaxy, or the like, with an opposite type of semiconductor material as compared to the substrate to create a p-n junction. In an embodiment, the material used to dope the substrate can be selected based on the sub-pixels being red sub-pixels 302. For example, the sub-pixels created during this manufacturing step can be created using aluminum gallium arsenide (AlGaAS), gallium arsenide phosphide (GaAsP), aluminum gallium indium phosphide (AlGaInP), gallium (III) phosphide (GaP), or the like. The openings 232 in the mask 230 allow the substrate 200 to be doped at the desired location to create red sub-pixels 302. Thus, all of the red sub-pixels 302 are created in the substrate during the same manufacturing step.

Figure 4:
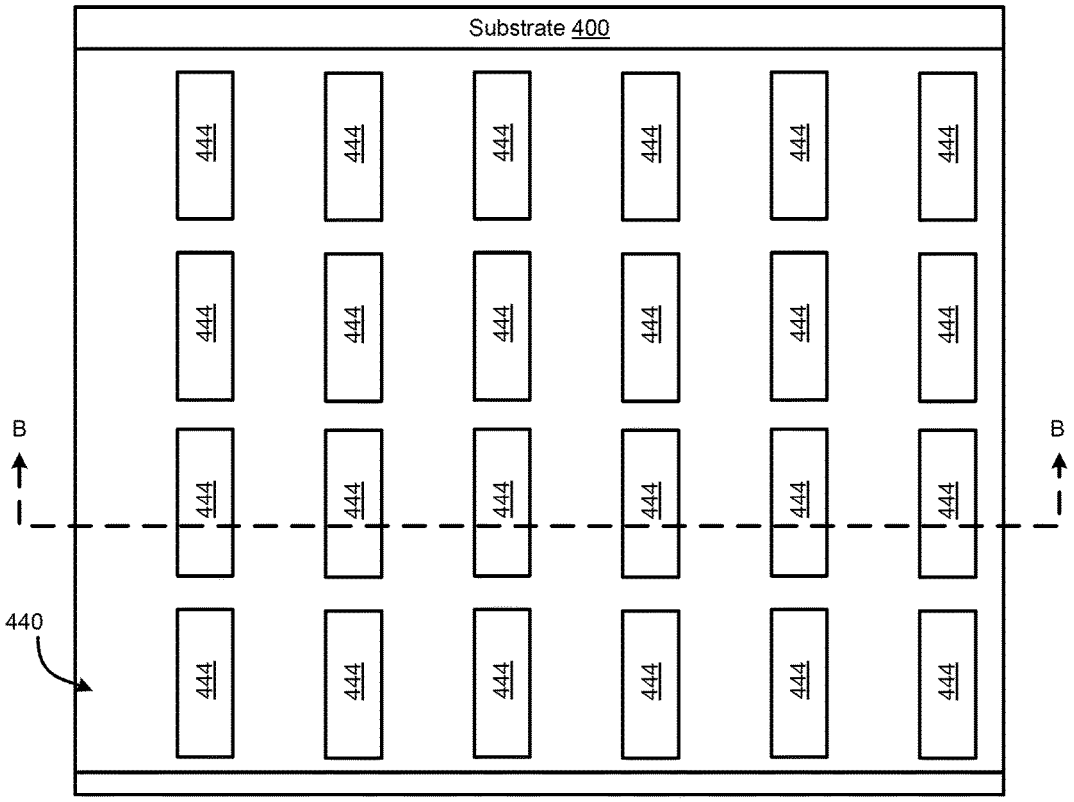
FIG. 4 is a diagram illustrating a second manufacturing mask on a substrate of the display in accordance with at least one embodiment of the present disclosure.
Figure 5:
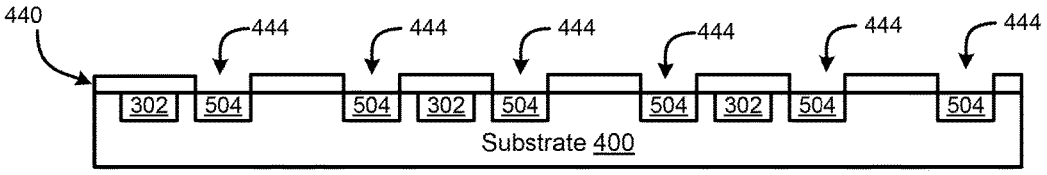
FIG. 5 is a diagram illustrating a cross section of the second manufacturing mask and the substrate in accordance with at least one embodiment of the present disclosure.

FIGS. 4 and 5 illustrate a second manufacturing mask 440 on a substrate 400 of a display in accordance with at least one embodiment of the present disclosure. The substrate 400 can be a first type of semiconductor material, such as n-type or a p-type. The mask 440 is then applied on top of the substrate. In an embodiment, the mask 440 includes a plurality of holes 444 to enable blue sub-pixels to be added to the substrate 400. FIG. 5 illustrates a cross section of the substrate 400 and the mask 440 taken along the line B-B in accordance with at least one embodiment of the present disclosure.

Referring now to FIG. 5, the substrate 400 can be doped with an opposite type of semiconductor material as compared to the substrate to create a p-n junction. In an embodiment, the material used to dope the substrate can be selected based on the sub-pixels being blue sub-pixels 504. For example, the sub-pixels created during this manufacturing step can be created using zinc selenide (ZnSe), indium gallium nitride (InGaN), or the like. The openings 444 in the mask 440 allow the substrate 400 to be doped at the desired location to create blue sub-pixels 504. Thus, all of the blue sub-pixels 504 are created in the substrate during the same manufacturing step. In an embodiment, there can be twice as many blue sub-pixels 504 as red sub-pixels as shown in FIG. 5.

Figure 6:
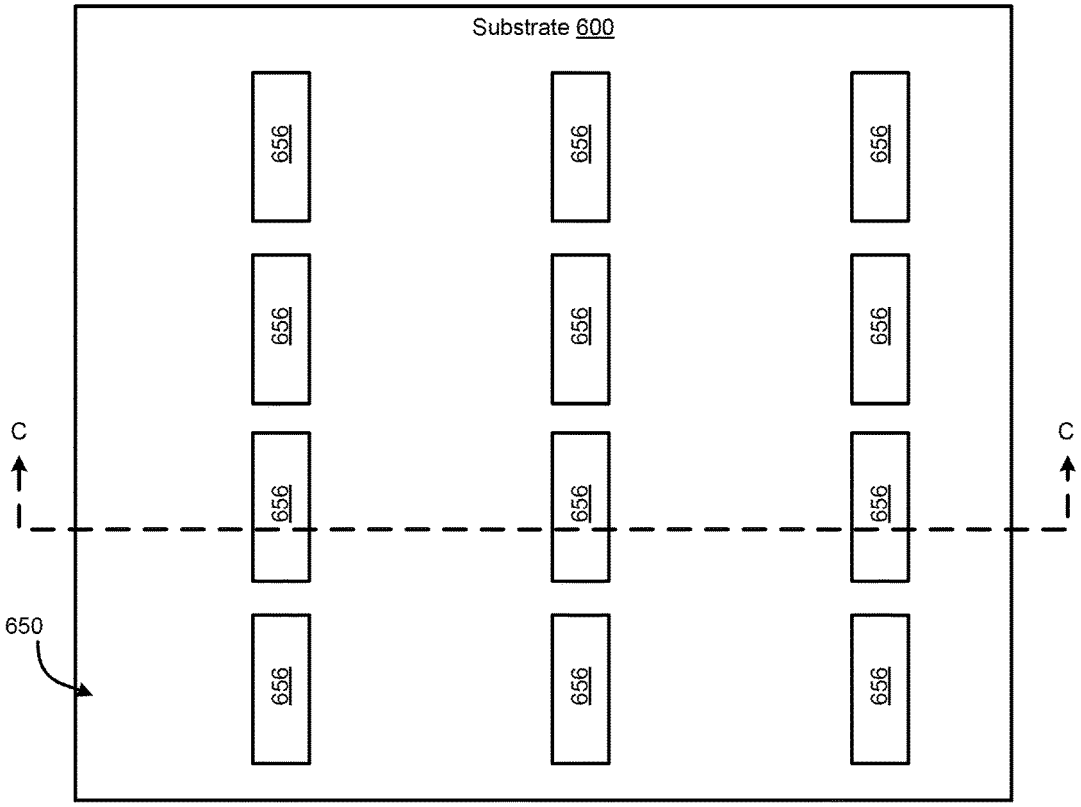
FIG. 6 is a diagram illustrating a third manufacturing mask on a substrate of the display in accordance with at least one embodiment of the present disclosure.
Figure 7:
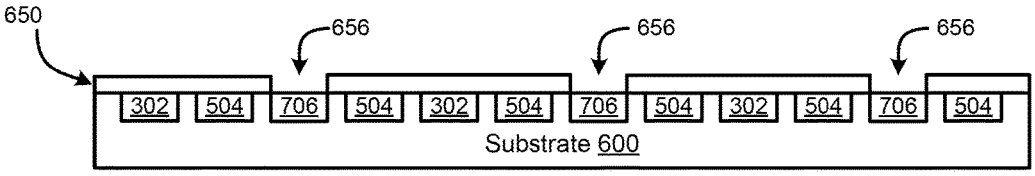
FIG. 7 is a diagram illustrating a cross section of the third manufacturing mask and the substrate in accordance with at least one embodiment of the present disclosure.

FIGS. 6 and 7 illustrate a third manufacturing mask 650 on a substrate 600 of a display in accordance with at least one embodiment of the present disclosure. The substrate 600 can be a first type of semiconductor material, such as n-type or a p-type. The mask 650 is then applied on top of the substrate. In an embodiment, the mask 650 includes a plurality of holes 656 to enable green sub-pixels to be added to the substrate 600. FIG. 7 illustrates a cross section of the substrate 600 and the mask 650 taken along the line C-C in accordance with at least one embodiment of the present disclosure.

Referring now to FIG. 7, the substrate 600 can be doped with an opposite type of semiconductor material as compared to the substrate to create a p-n junction. In an embodiment, the material used to dope the substrate can be selected based on the sub-pixels being green sub-pixels 706. For example, the sub-pixels created during this manufacturing step can be created using gallium (III) phosphide (GaP), aluminium gallium indium phosphide (AlGaInP), aluminium gallium phosphide (AlGaP), indium gallium nitride (InGaN), Gallium (III) nitride (GaN), or the like. The openings 656 in the mask 650 allow the substrate 600 to be doped at the desired location to create green sub-pixels 706. Thus, all of the green sub-pixels 706 are created in the substrate during the same manufacturing step. In an embodiment, there can be substantially the same number of green sub-pixels 706 as red sub-pixels 302, and substantially half as many green sub-pixels 706 as blue sub-pixels 504 as shown in FIG. 7.

Figure 8:
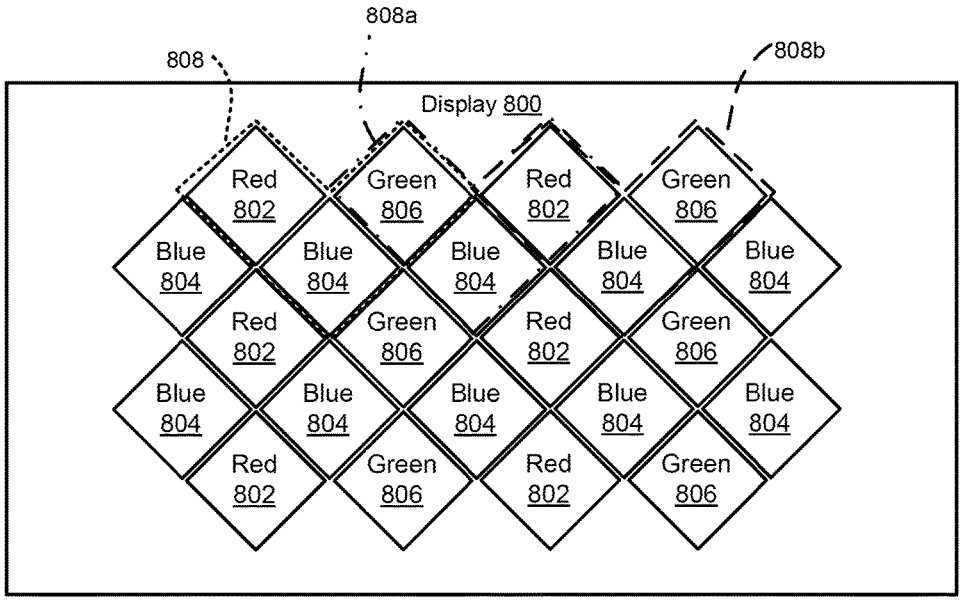
FIG. 8 is a diagram of another embodiment of color pixels on a display of an information handling system in accordance with at least one embodiment of the present disclosure.

FIG. 8 is a diagram of another embodiment of a display 800 of an information handling system in accordance with at least one embodiment of the present disclosure. The display 800 includes multiple red sub-pixels 802, multiple blue sub-pixels 804, and multiple green sub-pixels 806. A first pixel of the display 800 is created in response to one red sub-pixel 802, one blue sub-pixel 804, and one green sub-pixel 806 within a first location 808 being provided with a current to place the sub-pixels in an on state.

The sub-pixels 802, 804, and 806 are arranged as diamonds in rows and column on the display 800, such that a row includes either alternating red sub-pixels 802 and green sub-pixels 806, or includes only blue sub-pixels 804. For clarity and brevity, only a portion of the sub-pixels on the display have been shown in FIG. 8. However, one of ordinary skill in the art would recognize that the order of the sub-pixels stated above can continue across the display until a sufficient number of sub-pixels are used to provide a desired resolution of the display 800.

Display 800 can perform pixel shifting by shifting the image by one or two pixels horizontally. For example, a first pixel can be created at a first location 808 in an image on display 800 in response to the red sub-pixel 802, the blue sub-pixel 804, and the green sub-pixel 806 located within the box identified with the 808 in FIG. 8. The display 800 can then perform pixel shifting and the first pixel can shift to the location identified by the box 808*a* in FIG. 8. When the first pixel is shifted from location 808 to location 808*a* the first pixel is created by the combination of the red sub-pixel 802, the blue sub-pixel 804, and the green sub-pixel 806 within the box 808*a*. In this situation, the green sub-pixel 806 is shared by the first pixel in both locations 808 and 808*a*. In an embodiment, the image on the display 800 can be pixel shifted again and the location of the first pixel can shift to location 808*b*. At this location, the first pixel is created by the combination of the red sub-pixel 802, the blue sub-pixel 804, and the green sub-pixel 806 within the box 808*b*, such that a red sub-pixel is shared by the first pixel while in both location 808*a* and 808*b*. Thus, the red sub-pixels 802 and the green sub-pixels 806 are shared between pixel shifting locations. However, the blue sub-pixels 804 are not shared between pixel shifting locations.

In an embodiment, the pixel shifting can be performed in any other pattern, such as a zig-zag pattern, such that a blue sub-pixel 804 is utilized half as much as a neighboring red sub-pixel 802 and a neighboring sub-pixel 806. The direction and pattern of the pixel shifting can be the result of the sub-pixel configuration, such that selected pixel configuration reduces the amount of time that each blue sub-pixel 804 is powered on as compared to the red sub-pixels 802 and the green sub-pixels 806. Thus, different layout configuration of the sub-pixels 802, 804, and 806 can result in a different pixel shifting configuration, such as direction and/or pattern, but each pixel shifting configuration can reduce the utilization of the blue sub-pixels 804 as compared to the red sub-pixels 802 and the green sub-pixels 806.

This sub-pixel arrangement on display 800, can enable the blue sub-pixels 804 to be in an off state half the time in response to the blue sub-pixels not being shared between pixel shifting locations, such as between location 808 and 808*a*, and between location 808*a* and 808*b*. The reduced amount of time that the blue sub-pixels 804 are as compared to the red sub-pixels 802 can lower the degradation difference between the blue sub-pixels and the red sub-pixels. Similarly, reduced amount of time that the blue sub-pixels 804 are as compared to the green sub-pixels 806 can lower the degradation difference between the blue sub-pixels and the green sub-pixels. In an embodiment, the resolution of the display 800 can be above visible range. In an embodiment, the high resolution of the display 800 can enable the blue sub-pixels 806 in the off state to not be visible. Additionally, the resolution of the display 800 can make the pixel shifting of the image not be visible.

Figure 9:
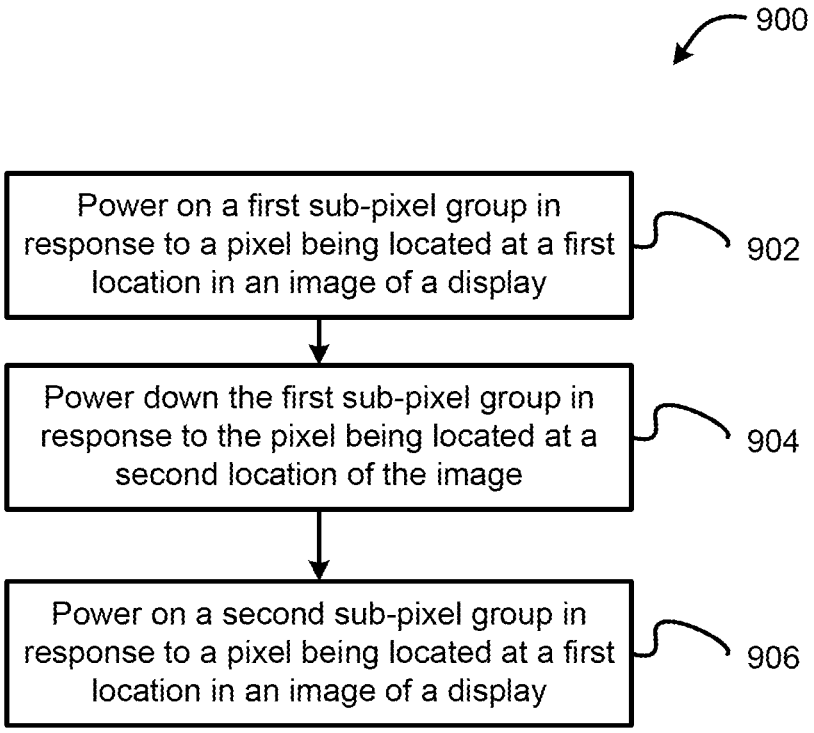
FIG. 9 is a flow diagram of a method for pixel shifting an image on the display of the information handling system.

FIG. 9 is a flow diagram of a method 900 for pixel shifting an image on a display of an information handling system. At block 902, a first sub-pixel group is powered on in response to a pixel being in a first location of the image on the display. In an embodiment, the first sub-pixel group includes a first color sub-pixel, a second color sub-pixel, and a third color sub-pixel. The first color sub-pixel can be a first color type, the second color sub-pixel can be a second color type, and the third sub-pixel can be a third color type. In an embodiment, the first color type can be red, the second color type can be blue, and the third color type can be green. In an embodiment, the first, second, and third color sub-pixels are placed horizontally adjacent to a color sub-pixel of another type in a row of the display. For example, the first color sub-pixel can be located at a first position, the second color sub-pixel can be located at a second position, and the third color sub-pixel can be located at a third position.

At block 904, the first sub-pixel group is powered down in response to the pixel being shifted to a second location of the display. In an embodiment, the pixel is shifted from the first location to the second location during a pixel shifting operation. A second sub-pixel group is powered on in response to the pixel being shifted to the second location of the display at block 906. In an embodiment, the second sub-pixel group includes the third color sub-pixel, a fourth color sub-pixel, and a fifth color sub-pixel. In an embodiment, the fourth color sub-pixel can be the second color type, and the fifth color sub-pixel can be the first color type. In an embodiment, the fourth color sub-pixel can be located a fourth position of the row, and the fifth color sub-pixel can be located a fifth position of the row.

When referred to as a "device," a "module," or the like, the embodiments described herein can be configured as hardware. For example, a portion of an information handling system device may be hardware such as, for example, an integrated circuit (such as an Application Specific Integrated Circuit (ASIC), a Field Programmable Gate Array (FPGA), a structured ASIC, or a device embedded on a larger chip), a card (such as a Peripheral Component Interface (PCI) card, a PCI-express card, a Personal Computer Memory Card International Association (PCMCIA) card, or other such expansion card), or a system (such as a motherboard, a system-on-a-chip (SoC), or a stand-alone device).

The device or module can include software, including firmware embedded at a device, such as a Pentium class or PowerPC™ brand processor, or other such device, or software capable of operating a relevant environment of the information handling system. The device or module can also include a combination of the foregoing examples of hardware or software. Note that an information handling system can include an integrated circuit or a board-level product having portions thereof that can also be any combination of hardware and software.

Devices, modules, resources, or programs that are in communication with one another need not be in continuous communication with each other, unless expressly specified otherwise. In addition, devices, modules, resources, or programs that are in communication with one another can communicate directly or indirectly through one or more intermediaries.

Although only a few exemplary embodiments have been described in detail herein, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

What is claimed is:

1. A display for an information handling system, the display comprising:

a first plurality of color sub-pixels, wherein each of the first color sub-pixels is a first color type;

a second plurality of color sub-pixels, wherein each of the second color sub-pixels is a second color type;

a third plurality of color sub-pixels, wherein each of the third color sub-pixels is a third color type, each of the first, second, and third color sub-pixels placed horizontally adjacent to another one of the first, second, and third-color sub-pixels of another color type in a row of the display, the first color sub-pixels located at a first position and a fifth position of the row, the second color sub-pixels located at a second position, fourth position, and sixth position of the row, and the third color sub-pixel located at a third position and a seventh position of the row; and a pixel including one of the first color sub-pixels, one of the second color sub-pixels, and one of the third color sub-pixels to create a part of an image on the display, wherein a first one of the first color sub-pixels, a first one of the second color sub-pixels, and a first one of the third color sub-pixels are lit in response to the pixel being in a first location of the display to create the part of the image, wherein a second one of the first color sub-pixels, a second one of the second color sub-pixels, and the first one of the third color sub-pixels are lit in response to the pixel being shifted to a second location of the display to create image shifting of the image, wherein the display includes twice as many second color sub-pixels as compared to the first color sub-pixels, and twice as many second color sub-pixels as compared to the third color sub-pixels.

2. The display of claim 1, wherein all of the first color sub-pixels are created using a single first manufacturing mask, all of the second color sub-pixels are created using a single second manufacturing mask, and all of the third color sub-pixels are created using a single third manufacturing mask.

3. The display of claim 1, wherein a first half of the second color sub-pixels are in an off state and a second half of the second color sub-pixels are in an on state in response to a first location of an image on the display, and the first half of the second color sub-pixels are in the on state and the second half of the second color sub-pixels are in the off state in response to a second location of the image on the display.

4. The display of claim 1, wherein a resolution of the display is above a threshold level, and the second color sub-pixels in the off state are not visible in response to the resolution being above the threshold level.

5. The display of claim 1, wherein the first color type is red, the second color type is blue, and the third color type is green.

6. A display for an information handling system, the display comprising:

a first color sub-pixel of a first color type;

a second color sub-pixel of a second color type;

a third color sub-pixel of a third color type;

a fourth color sub-pixel of the second color type, each of the first, second, third, and fourth color sub-pixels are placed horizontally adjacent to another one of the first, second, third, and fourth color sub-pixels of another color type in a row of the display, the first color sub-pixel is located at a first position, the second color sub-pixel is located at a second position, the third color sub-pixel is located at a third position, and the fourth color sub-pixel is located a fourth position of the row; and a fifth color sub-pixel of the first color type located at a fifth position of the row; and wherein the first color sub-pixel, the second color sub-pixel, and the third color sub-pixel are lit in response to a pixel being in a first location of the display to create a part of an image, wherein the third color sub-pixel, the fourth color sub-pixel, and the fifth color sub-pixel are lit in response to the pixel being shifted to a second location of the display to create image shifting of the image.

7. The display of claim 6, wherein the display includes twice as many color sub-pixels of the second color type as compared to color sub-pixels of the first color type, and twice as many color sub-pixels of the second color type as compared to color sub-pixels of the third color type.

8. The display of claim 6, wherein all color sub-pixels of the first color type are created using a single first manufacturing mask, all color sub-pixels of the second color type are created using a single second manufacturing mask, and all color sub-pixels of the third color type are created using a single third manufacturing mask.

9. The display of claim 6, wherein a resolution of the display is above a threshold level, and the color sub-pixels of the second color type in the off state are not visible in response to the resolution being above the threshold level.

10. The display of claim 6, wherein the first color type is red, the second color type is blue, and the third color type is green.

11. A method comprising:

powering on a first color sub-pixel, a second color sub-pixel, and a third color sub-pixel in response to a pixel being in a first location of an image on a display of an information handling system, wherein the first color sub-pixel is a first color type, the second color sub-pixel is a second color type, and the third color sub-pixel is a third color type, the first, second, and third color sub-pixels are placed horizontally adjacent to a color sub-pixel of another type in a row of the display, the first color sub-pixel is located at a first position, the second color sub-pixel is located at a second position, and the third color sub-pixel is located at a third position;

powering down the first color sub-pixel and the second color sub-pixel in response to the pixel being shifted to a second location of the display to create shifting of an image; and powering on the third color sub-pixel, a fourth color sub-pixel, and a fifth color sub-pixel in response to the pixel being shifted to the second location, wherein the fourth color sub-pixel is the second color type and the fifth color sub-pixel is the first color type, the fourth color sub-pixel is located at a fourth position of the row, and the fifth color sub-pixel is located at a fifth position of the row, wherein the display includes twice as many color sub-pixels of the second color type as compared to color sub-pixels of the first color type, and twice as many color sub-pixels of the second color type as compared to color sub-pixels of the third color type.

12. The method of claim 11, wherein all color sub-pixels of the first color type are created using a single first manufacturing mask, all color sub-pixels of the second color type are created using a single second manufacturing mask, and all color sub-pixels of the third color type are created using a single third manufacturing mask.

13. The method of claim 11, wherein a resolution of the display is above a threshold level, and the color sub-pixels of the second color type in the off state are not visible in response to the resolution being above the threshold level.

14. The method of claim 11, wherein the first color type is red, the second color type is blue, and the third color type is green.

* * * * *